US009494000B2

(12) United States Patent
Grigsby et al.

(10) Patent No.: US 9,494,000 B2
(45) Date of Patent: Nov. 15, 2016

(54) METHODS OF MAINTAINING SUFFICIENT HYDROSTATIC PRESSURE IN MULTIPLE INTERVALS OF A WELLBORE IN A SOFT FORMATION

(75) Inventors: Tommy Frank Grigsby, Houston, TX (US); Bruce Techentien, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 641 days.

(21) Appl. No.: 13/020,618

(22) Filed: Feb. 3, 2011

(65) Prior Publication Data

US 2012/0199362 A1 Aug. 9, 2012

(51) Int. Cl.
*E21B 21/08* (2006.01)
*E21B 43/14* (2006.01)

(52) U.S. Cl.
CPC ..... *E21B 21/08* (2013.01); *E21B 43/14* (2013.01)

(58) Field of Classification Search
CPC ..... E21B 43/04; E21B 34/08; E21B 43/16; E21B 43/162; E21B 43/25; E21B 43/26; E21B 43/14; E21B 21/08
USPC ..... 166/373, 378, 381, 56, 205, 227
See application file for complete search history.

(56) References Cited

U.S. PATENT DOCUMENTS

| | | | | |
|---|---|---|---|---|
| 5,547,029 | A * | 8/1996 | Rubbo et al. | 166/375 |
| 6,230,801 | B1 * | 5/2001 | Hill et al. | 166/278 |
| 6,253,857 | B1 * | 7/2001 | Gano | 166/386 |
| 6,484,816 | B1 | 11/2002 | Koederitz | |
| 6,622,794 | B2 * | 9/2003 | Zisk, Jr. | 166/373 |
| 6,675,891 | B2 * | 1/2004 | Hailey et al. | 166/228 |
| 6,776,238 | B2 * | 8/2004 | Dusterhoft | E21B 33/124 166/177.5 |
| 7,819,194 | B2 | 10/2010 | Tips | |
| 8,474,535 | B2 * | 7/2013 | Richards et al. | 166/325 |
| 2002/0108755 | A1 * | 8/2002 | Zisk, Jr. | 166/369 |
| 2003/0075324 | A1 * | 4/2003 | Dusterhoft et al. | 166/279 |
| 2003/0111224 | A1 * | 6/2003 | Hailey et al. | 166/278 |
| 2003/0188871 | A1 * | 10/2003 | Dusterhoft et al. | 166/308 |
| 2006/0157282 | A1 | 7/2006 | Tilton et al. | |
| 2009/0159279 | A1 * | 6/2009 | Assal | 166/278 |
| 2010/0276160 | A1 | 11/2010 | Tolman et al. | |
| 2012/0103606 | A1 * | 5/2012 | van Petegem et al. | 166/278 |

OTHER PUBLICATIONS

Singapore Examination Report; mailed Oct. 24, 2014; Singapore Application No. 201305631-2.

* cited by examiner

*Primary Examiner* — Elizabeth Gitlin
(74) *Attorney, Agent, or Firm* — McGuireWoods, LLP

(57) ABSTRACT

This Application addresses maintaining a hydrostatic pressure exerted on a wall of a wellbore in different intervals of the wellbore. This is done by flowing a liquid through at least a pressure regulator in each interval, and wherein each pressure regulators regulates the amount of pressure exerted by the liquid on the wall of the wellbore. The amount of pressure may be maintained for a specific period of time. The wellbore is part of a soft subterranean formation.

17 Claims, 1 Drawing Sheet

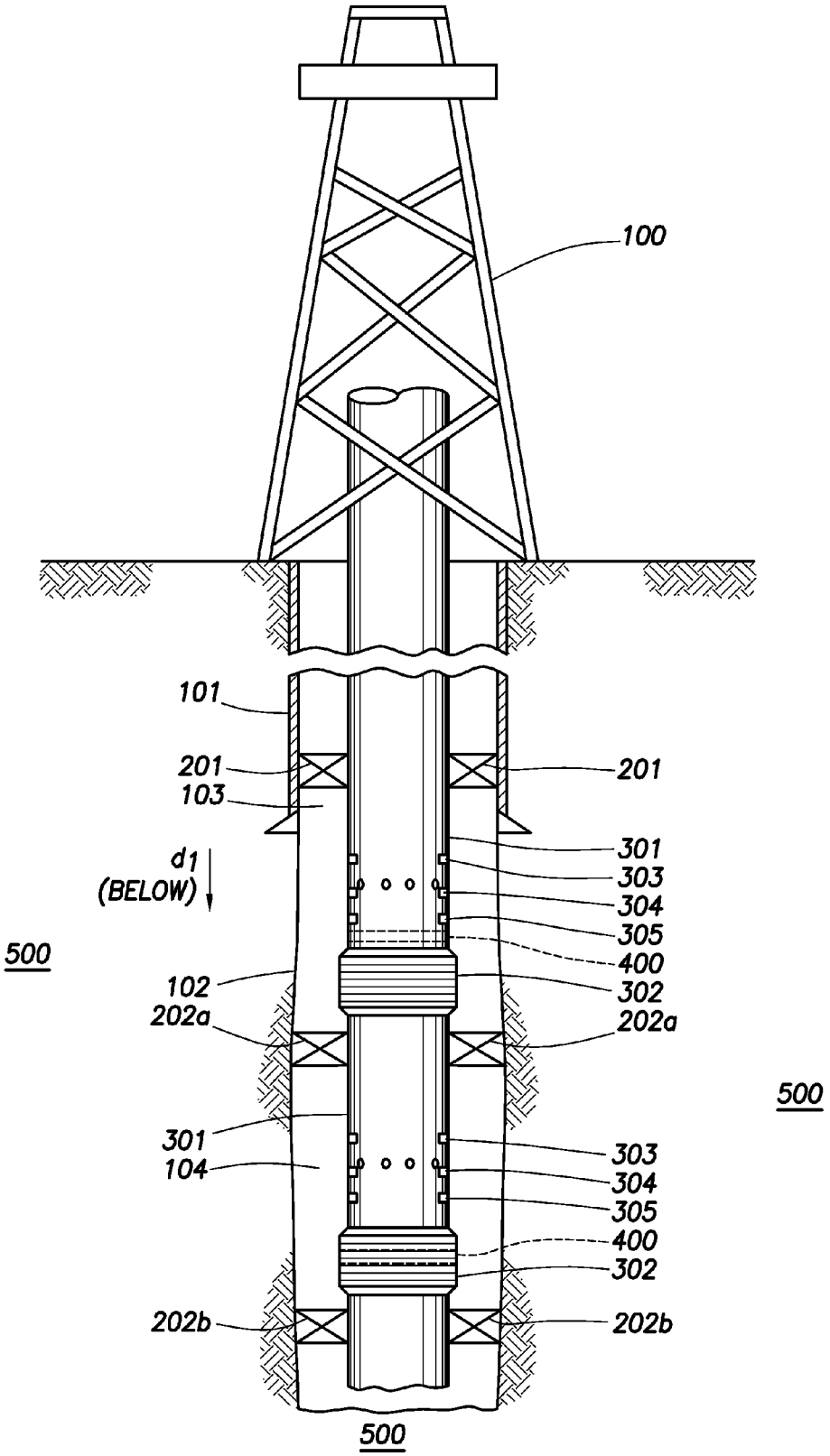
100
101
201
201
103
d1
(BELOW)
301
303
304
305
400
302
500
102
202a
202a
500
301
104
303
304
305
400
302
202b
202b
500

METHODS OF MAINTAINING SUFFICIENT HYDROSTATIC PRESSURE IN MULTIPLE INTERVALS OF A WELLBORE IN A SOFT FORMATION

TECHNICAL FIELD

Methods for maintaining a hydrostatic pressure exerted on a wall of a wellbore or a face of a subterranean formation to maintain the integrity of a soft formation are provided. The wellbore includes at least two intervals. According to an embodiment, a liquid is flowed through at least a first and second pressure regulator, wherein at least one of the pressure regulators is located in each of the intervals such that the pressure regulators regulates the amount of pressure exerted by the liquid on the wall of the wellbore. According to another embodiment, all of the pressure regulators are used to maintain the hydrostatic pressure by maintaining liquid communication with each of the intervals.

SUMMARY

According to an embodiment, a method of maintaining a hydrostatic pressure exerted on a wall of a wellbore in at least a first interval and a second interval of the wellbore, comprises the steps of: flowing a liquid through at least a first pressure regulator and a second pressure regulator, wherein the first pressure regulator is located in the first interval of the wellbore, wherein the second pressure regulator is located in the second interval of the wellbore, and wherein each of the first and second pressure regulators regulates the amount of pressure exerted by the liquid on the wall of the wellbore; and maintaining the amount of pressure for a specific period of time.

According to another embodiment, a method of maintaining a hydrostatic pressure in multiple intervals of a soft subterranean formation, comprises the steps of: using a pressure regulator to maintain an amount of pressure exerted by a liquid on the face of the subterranean formation in each of the multiple intervals, wherein the step of using comprises maintaining liquid communication with each of the multiple intervals.

BRIEF DESCRIPTION OF THE FIGURES

The features and advantages of certain embodiments will be more readily appreciated when considered in conjunction with the accompanying figures. The figures are not to be construed as limiting any of the preferred embodiments.

FIG. 1 is a diagram of a portion of a well system including sand control assemblies comprising a pressure regulator.

DETAILED DESCRIPTION

As used herein, the words "comprise," "have," "include," and all grammatical variations thereof are each intended to have an open, non-limiting meaning that does not exclude additional elements or steps.

It should be understood that, as used herein, "first," "second," "third," etc., are arbitrarily assigned and are merely intended to differentiate between two or more pressure regulators, intervals, sand control assemblies, etc., as the case may be, and does not indicate any particular orientation or sequence. Furthermore, it is to be understood that the mere use of the term "first" does not require that there be any "second," and the mere use of the term "second" does not require that there be any "third," etc.

As used herein, a "fluid" is a substance having a continuous phase that tends to flow and to conform to the outline of its container when the substance is tested at a temperature of 71° F. (22° C.) and a pressure of one atmosphere "atm" (0.1 megapascals "MPa"). A fluid can be a liquid or gas.

Oil and gas hydrocarbons are naturally occurring in some subterranean formations. A subterranean formation containing oil or gas is sometimes referred to as a reservoir. A reservoir may be located under land or offshore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir.

A well can include, without limitation, an oil, gas, water, or injection well. A well used to produce oil or gas is generally referred to as a production well. As used herein, a "well" includes at least one wellbore. A wellbore can include vertical, inclined, and horizontal portions, and it can be straight, curved, or branched. As used herein, the term "wellbore" includes any cased, and any encased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within about 100 feet of the wellbore. As used herein, "into a well" means and includes into any portion of the well, including into the wellbore or into the near-wellbore region via the wellbore.

A portion of a wellbore may be an open hole or cased hole. In an open-hole wellbore portion, a tubing string may be placed into the wellbore. The tubing string allows fluids to be introduced into or flowed from a remote portion of the wellbore. In a cased-hole wellbore portion, a casing is placed into the wellbore which can also contain a tubing string. A wellbore can contain an annulus. Examples of an annulus include, but are not limited to: the space between the wall of the wellbore and the outside of a work string (such as a tubing string) in an open-hole wellbore; the space between the wall of the wellbore and the outside of a casing in a cased-hole wellbore; and the space between the inside of a casing and the outside of a tubing string in a cased-hole wellbore.

Well completion is generally performed in order to enable production of oil or gas from a reservoir. A variety of completion equipment can be used during the completion process. The specific equipment used for well completion can differ for a cased-hole wellbore versus an open-hole wellbore. Moreover, the specific equipment used for well completion can differ for a consolidated formation versus an unconsolidated or loosely consolidated formation, also known as a "soft formation."

In the case of soft formations, fines, such as sediment and sand, can enter the tubing string during the production of oil or gas. When this occurs, several problems can arise, for example, erosion of production equipment, well plugging, decreased production of oil or gas, or production of the fines along with the oil or gas. In soft, open-hole formations, part of the formation can cave in and collapse, resulting in a loss of the annular space between the wall of the wellbore and the outside of the work string.

In order to stabilize the formation from collapsing in a soft, open-hole wellbore, a fluid overbalance is required. A fluid overbalance is generally performed by placing a fluid, such as a completion brine, into the annulus at a hydrostatic pressure that exceeds the pressure exerted by fluids in the subterranean formation. In this manner, the greater pressure on the wall of the wellbore helps to keep the formation from collapsing into the annular space. As used herein, the term "hydrostatic pressure" means the force per unit area exerted by a column of fluid at rest. Two factors that can affect the hydrostatic pressure are the density of the fluid and the depth of the fluid below the earth's surface or the surface of a body of water. Hydrostatic pressure can be calculated using the equation: P=MW*Depth*0.052, where MW is the density of the fluid in pounds per gallon (PPG), Depth is the true vertical depth in feet, and 0.052 is a unit conversion factor to units of pounds per square inch (psi).

A fluid overbalance can also include depositing a filtercake into a well. In filtercake deposition, a fluid (such as a slurry) is introduced into the wellbore. The fluid flows into a desired portion of the well. The ingredients in the fluid can form the filtercake. A filtercake can be a relatively impermeable sheath or a permeable network, which binds fines, such as sand, together while allowing fluids to flow through the interconnected pores in the filtercake. A filtercake can coat the wall of a wellbore and it can also penetrate a certain depth into the near-wellbore region.

Sand control is a technique often used in soft openhole formations. Examples of sand control techniques include, but are not limited to, depositing a filtercake in a portion of the well, using sand control assemblies, and gravel packing. A common sequence of sand control techniques is to first deposit a filtercake in the desired portion of the well, then install a sand control assembly in the wellbore, and finally gravel pack the wellbore. Sand control assemblies often include a slotted liner and/or a screen. A slotted liner can be a perforated pipe, such as a blank pipe. The screen usually contains holes that are smaller than the perforations in the slotted liner. The liner and/or screen can cause bridging of the fines against the liner or screen as oil or gas is being produced. Gravel packing is often performed in conjunction with the use of sand control assemblies. Gravel is proppant having a particle-size class above sand, which is defined as having a largest dimension ranging from greater than 2 millimeters (mm) up to 64 mm. In gravel packing, a packer and a sand control assembly with a washpipe inside the assembly are usually run in the wellbore with a service tool. The gravel is then commonly placed in a portion of an annulus between the wall of the wellbore and the outside of the screen at a location below the packer. The gravel helps to trap and restrain fines from entering the production equipment or plugging the holes in the liner or screen while at the same time stabilizing the formation.

In some formations, it is often necessary to fracture a portion of the subterranean formation. Fracturing is a common stimulation treatment. A treatment fluid adapted for this purpose is sometimes referred to as a "fracturing fluid." The fracturing fluid is pumped at a sufficiently high flow rate and high pressure into the wellbore and into the subterranean formation to create or enhance a fracture in the subterranean formation. The fracture provides a highly-permeable flow path for oil or gas to be produced. The fracture in soft rock formations will tend to close together after the pumping of the fracturing fluid is stopped. To prevent the fracture from closing, a material must be placed in the fracture to keep the fracture propped open. A material used for this purpose is often referred to as a "proppant." It is often desirable to create multiple fractures at multiple downhole locations.

As mentioned above, a wellbore can extend vertically, at an angle, horizontally, and combinations thereof, for several hundreds of feet into a subterranean formation. A wellbore can only include one zone, also known as an interval. A wellbore can also include multiple zones or multiple intervals. As used herein, an "interval" means the space between two objects. As the length of wellbores have increased, the ability to complete the wellbore as a single interval has become difficult. As a result, it is common to create more than one interval in a wellbore for wellbore operations, such as completion or stimulation. For example, during well completion, a portion of an annulus can be partitioned off from other portions of the annulus. In this manner, portions of the annulus can be sealed so fluids will not flow through the annulus but rather will flow through the tubing string or casing. By sealing portions of the annulus, oil or gas can be produced in a controlled manner through the wellhead via the tubing string or casing. By way of another example, during stimulation operations, one interval of the formation may be relatively impermeable compared to another interval of the formation. By creating multiple intervals, fracturing of the formation can be performed within the desired intervals. By segmenting or restricting a fracture interval length, the fracture treatment design can be optimized for each interval.

Hydraulic, hydrostatic, or swellable packers can be utilized to create multiple intervals. A common example of an interval in a wellbore is the annular space between two packers. A hydraulic packer is hydraulically actuated and carries a packer element. A hydrostatic packer is actuated by the pressure in the wellbore and carries a packer element. The packer element is a ring fitted on the outside of a mandrel attached to a tubing string or casing. Hydraulic actuation of the packer axially squeezes the packer element to cause radial expansion of the packer element and seals the annulus. A swellable packer includes a swellable element, which can swell to a size that is larger than the size of the pre-swelled element. The swellable element is a ring fitted around the outside of a portion of a tubing string or casing or a mandrel attached to either. The swellable element is normally axially constrained on the top and bottom such that the swellable element can expand in a radial direction only. As the swellable element swells, it expands radially and seals the part of the annulus. As used herein, the term "setting the packer" and all grammatical variations thereof, means an act that causes the packer element or swellable element to expanded sufficiently to seal the part of the annulus that the packer is located in.

As used herein, a "top packer" means the packer that is closest to the wellhead. Other packers can be situated below the top packer. It should be understood that the use of the words "top" and "below" are meant to describe a position in relation to a wellhead and are not meant to imply a vertical direction. While for a vertical well, the use of the words top and below will refer to a vertical direction, for an inclined or horizontal well, the words do not refer to a vertical direction. For example, in a horizontal well, the "top packer" is the packer that is positioned closest to the wellhead, and the formation "below" the top packer means the part of the subterranean formation that is farther away from the wellhead compared to the top packer.

There are many causes for a loss of fluid overbalance. Such causes can include, but are not limited to, reduction in the weight of the completion fluid, damage to the filtercake (causing fluid to leak off into the formation), tool movement which removes part of the filtercake, and a loss of hydrostatic pressure when setting a packer. The loss of hydrostatic pressure when setting a packer can occur because, after a top packer is set, there is generally a loss of fluid communication with the formation situated below the top packer. In soft formations, this loss of fluid communication can allow the formation to cave in and collapse in the annular space below the top packer. Thus, there is a need to be able to perform well completion (including sand control techniques) in a multiple interval wellbore located in a soft formation while maintaining the integrity of the formation.

A novel method of maintaining a hydrostatic pressure exerted on a wall of a wellbore in at least a first interval and a second interval of the wellbore, comprises the steps of: flowing a liquid through at least a first pressure regulator and a second pressure regulator, wherein the first pressure regulator is located in the first interval of the wellbore, wherein the second pressure regulator is located in the second interval of the wellbore, and wherein each of the first and second pressure regulators regulates the amount of pressure exerted by the liquid on the wall of the wellbore; and maintaining the amount of pressure for a specific period of time. One of the advantages to the methods described herein, is that regardless of whether the potential loss of pressure is a result of loss of a portion of a filtercake, or for some other reason, the methods allow for a relatively constant pressure to be maintained in each of the intervals of the wellbore. Another advantage is that the required pressure needed to maintain the integrity of the formation may vary from interval to interval, and the methods allow for the maintenance of the particular required pressure for each of the intervals. Yet another advantage to the methods is that the pressure can be regulated for each interval at a pressure that is optimal for each interval. For example, if the pressure exerted on the formation is too high, premature fracturing of the formation can occur. The pressure regulator can be set to a pressure that is below the fracturing pressure.

According to an embodiment, a method of maintaining a hydrostatic pressure exerted on a wall of a wellbore in at least a first interval and a second interval of the wellbore, comprises the steps of: flowing a liquid through at least a first pressure regulator and a second pressure regulator, wherein the first pressure regulator is located in the first interval of the wellbore, wherein the second pressure regulator is located in the second interval of the wellbore, and wherein each of the first and second pressure regulators regulates the amount of pressure exerted by the liquid on the wall of the wellbore; and maintaining the amount of pressure for a specific period of time.

According to another embodiment, a method of maintaining a hydrostatic pressure in multiple intervals of a soft subterranean formation, comprises the steps of: using a pressure regulator to maintain an amount of pressure exerted by a liquid on the face of the subterranean formation in each of the multiple intervals, wherein the step of using comprises maintaining liquid communication with each of the multiple intervals.

Turning to the Figures, FIG. 1 is a diagram of a portion of a well system according to certain embodiments. Any discussion of a particular component of the well system (e.g., a pressure regulator 400) is meant to include the singular form of the component and also the plural form of the component, without the need to continually refer to the component in both the singular and plural form throughout. For example, if a discussion involves "the pressure regulator 400," it is to be understood that the discussion pertains to one pressure regulator (singular) and two or more pressure regulators (plural). The discussion regarding certain embodiments may refer to a first and second pressure regulator, a first and second interval, etc.; however, it is to be understood that there can be a third or more pressure regulators, a third or more intervals, etc.

The wellbore can be a vertical wellbore, angled wellbore, horizontal wellbore, or combinations thereof. A subterranean formation can be penetrated by the wellbore. The wellbore can be a cased-hole, an open-hole, or a combination of cased-hole and open-hole. Preferably, at least a portion of the wellbore is an open-hole wellbore. For example, a portion of the wellbore can contain a casing 101, whereas another portion of the wellbore does not contain the casing 101. The wellbore can contain at least one annulus. By way of example, the wellbore can contain an annulus 104 between the wall of the wellbore 102 and the blank pipe 301. The wellbore can also contain an annulus 103 between the casing 101 and the blank pipe 301. It is to be understood that the annulus 104 is intended to be an open-hole annulus; whereas the annulus 103 is intended to be a cased-hole annulus. Either one of the annuli 104 or 103 do not have to include the blank pipe 301, but can be a space between a work string (not shown) and either the wall of the wellbore 102 or the casing 101.

The methods include maintaining a hydrostatic pressure exerted on the wall of a wellbore 102 in at least a first interval and a second interval of the wellbore. Preferably, at least one of the first and second intervals is part of a soft formation. More preferably, each of the first and second intervals are part of a soft formation. According to an embodiment, there are more than two intervals of the wellbore. For example, the wellbore can include a multiple interval wellbore. A first pressure regulator 400 is located in the first interval and a second pressure regulator 400 is located in the second interval. Preferably, there is at least one pressure regulator 400 located in each interval, regardless of the total number of intervals. There can be more than one pressure regulator located in the first interval, the second interval, or combinations thereof. According to another embodiment, there is more than one pressure regulator 400 located in each of the intervals.

The pressure regulator 400 is preferably part of a sand control assembly. The first pressure regulator can be part of a first sand control assembly and the second pressure regulator can be part of a second sand control assembly. At least the first sand control assembly can be located in the first interval and at least the second sand control assembly can be located in the second interval. More than one sand control assembly can be located in each interval. Any of the sand control assemblies can include an upper seal bore 303, a closing sleeve 304, an indicator nipple 305, and a screen 302. According to an embodiment, the upper seal bore 303, closing sleeve 304, and indicator nipple 305 remain in the wellbore after sand control has been completed. The sand control assemblies can further include a blank pipe 301. Most preferably, the first and second pressure regulators 400 are attached to the screen 302, blank pipe 301, or combinations thereof of the first and second sand control assemblies, respectively. For example, the first pressure regulator 400 can be attached to the blank pipe 301 of the first sand control assembly while the second pressure regulator 400 can be attached to the screen 302 of the second sand control assembly. The first pressure regulator 400 positioned closest to the wellhead 100 is shown in FIG. 1 as being attached to the blank pipe 301 while the second pressure regulator 400 farthest away from the wellhead 100 is shown in FIG. 1 as being attached to the screen 302. Of course, when there is more than one regulator 400 in each interval, then one regulator 400 can be attached to the blank pipe 301 and the other regulator 400 can be attached to the screen 302 or both could be attached to the pipe or screen. According to an embodiment, the first and second pressure regulators 400 are attached to the outside of the screen 302, blank pipe 301, or combinations thereof of the first and second sand control assemblies, respectively.

The methods can further include the step of placing at least the first pressure regulator 400 in the first interval and at least the second pressure regulator 400 in the second interval. According to this embodiment, the step of placing can include the step of installing at least the first and second sand control assemblies. Preferably, the installation of all of the sand control assemblies is performed in a single trip. As used herein, the term "single trip" means that the assemblies are simultaneously run into the wellbore using a string, as opposed to running one assembly and then removing the string to subsequently run another assembly.

The methods can further include the step of creating at least the first and second intervals in the subterranean formation. By way of example, the methods can include the step of placing a top packer 201 and at least two isolation packers 202 in the desired portions of the wellbore. The top packer 201 can be a gravel packer. The first interval can be located between the top packer 201 and an isolation packer 202*a*. The second interval can be located between two isolation packers 202*a* and 202*b*. If there are more than two intervals, then any additional intervals are preferably located between isolation packers (not shown). While FIG. 1 depicts the first interval being between the top packer 201 and the isolation packer 202*a*, and the second interval being between the isolation packer 202*a* and the isolation packer 202*b*, there can be multiple intervals located below the isolation packer 202*b*. Moreover, while only two isolations packers 202*a* and 202*b* are depicted, there can be multiple isolation packers located in the wellbore.

In a preferred embodiment, the step of placing any of the packers 201 and/or 202 is performed prior to the step of installing the first and second sand control assemblies. The methods can further include the step of setting the packers 201 and/or 202 after the step of placing the packers 201 and/or 202. The packers 201 and 202 can be placed in the wellbore such that after setting, at least one portion of the annulus 103 or 104 is sealed off from another portion of the annulus. The step of setting the isolation packers 202*a* and 202*b* can be performed after the step of setting the top packer 201. According to an embodiment, a method of maintaining a hydrostatic pressure in multiple intervals of a soft subterranean formation, comprises the steps of: using all of at least one pressure regulator located in each of the multiple intervals to maintain an amount of pressure exerted by a liquid on the face of the subterranean formation in each of the multiple intervals, wherein the step of using comprises maintaining liquid communication with each of the multiple intervals. By way of example, prior techniques involved a loss of liquid communication with the subterranean formation below a top packer after the top packer was set. In order to maintain the integrity of formation 500, the methods can include the step of maintaining liquid communication with each of the multiple intervals located below the top packer 201 after the step of setting the top packer 201. Preferably, liquid communication is maintained in each of the multiple intervals simultaneously. According to this embodiment, at least one pressure regulator 400 is located in each of the multiple intervals. Furthermore, all of the at least one pressure regulators 400 located in each of the multiple intervals is used to maintain an amount of pressure exerted by the liquid. The face of the subterranean formation 500 can be a wall of a wellbore 102. All of the pressure regulators 400 can be used to maintain liquid communication. The pressure regulators 400 can be used to maintain liquid communication by flowing a liquid through each of the regulators. The step of maintaining liquid communication can include maintaining liquid communication between the screen, blank pipe, or combinations thereof 302 and/or 301 and the wall of the wellbore 102 or the face of the subterranean formation. The liquid communication can include pumping the liquid from the wellhead 100, down the work string (not shown), through the screen or pipe 302 or 301, through the pressure regulator 400, and into the annulus for each interval 103 and 104. In a preferred embodiment, liquid communication is maintained between the screen or pipe 302 or 301 and the wall of the wellbore 102 at a position below (in the direction of $d_1$) the top packer 201.

The methods can also include any of the steps necessary for performing sand control. The methods can further include the step of depositing a filtercake on at least a portion of the wall of the wellbore 102, and preferably the step of depositing is performed prior to the step of flowing a liquid through at least the first and second pressure regulators 400. The step of depositing is also preferably performed before the step of installing the first and second sand control assemblies. In this manner, the filtercake can help prevent collapse of the wall of the wellbore 102, and can be relatively impermeable thus preventing fluids from leaking off into the formation while allowing hydrostatic pressure to be created in the annuli 103 and 104. The methods can also include the step of placing gravel in at least a portion of at least one of the intervals. Only one, more than one, or all of the intervals can be gravel packed. The methods can also include the step of creating at least one fracture in at least one of the intervals after the step of maintaining.

The methods include the step of flowing a liquid through at least the first pressure regulator 400 and the second pressure regulator 400. According to an embodiment, a liquid is flowed through multiple pressure regulators 400 in addition to the first and second pressure regulators. According to another embodiment, a liquid is flowed through all of the at least one pressure regulators located in each of the multiple intervals. The step of flowing can include pumping a liquid through the pressure regulator 400. Preferably, the step of flowing comprises simultaneously flowing the fluid through at least the first and second pressure regulators 400. By way of example, the step of flowing can comprise flowing the fluid through a work string, through the inner diameter of the screen 302 or blank pipe 301, through each of the pressure regulators 400, and into the annuli 103 and 104. Any of the pressure regulators 400 can further include a backflow device. The back flow device can help prevent fluid from entering the inner diameter of the screen or blank pipe 302 or 301 via the regulator 400 from the outer diameter of the screen or pipe.

The methods include maintaining an amount of pressure exerted by the liquid on the wall of the wellbore 102 or the face of the subterranean formation 500. The amount of pressure can be predetermined. The amount of pressure can vary. The amount of pressure can also be different for each interval or the amount of pressure can be the same for each interval. For example, the amount of pressure for the first interval can be the same or different from the amount of pressure for the second interval. The pressure regulator 400 can be pre-set to a desired or predetermined amount of pressure. For example, if the amount of pressure needed to maintain the integrity of the first interval is determined to be 150 psi and the amount of pressure needed to maintain the integrity of the second interval is determined to be 250 psi, then the first regulator 400 can be pre-set to 150 psi and the second regulator 400 can be pre-set to 250 psi. In this manner, each of the regulators 400 can be pre-set to the desired or predetermined amount of pressure for each interval. Preferably, the desired or the pre-determined pressure for each interval is the minimum pressure needed to maintain the integrity for that interval. Accordingly, the pressure regulator 400 can be pre-set such that the regulator 400 does not allow the pressure exerted on the wall of the wellbore or the face of the subterranean formation to increase above, or fall below, the amount of pressure. Preferably, the amount of pressure is equal to or greater than the fluid overbalance. More preferably, the amount of pressure is at least sufficient to prevent the majority of the wall of the wellbore 102 or the face of the subterranean formation from collapsing in that interval. Most preferably, the amount of pressure is less than the amount of pressure needed to create a fracture in the subterranean formation for that interval.

The methods include the step of maintaining the amount of pressure for a specific period of time. According to an embodiment, the specific period of time is the time needed to set the top packer 201, place at least the first and second pressure regulators 400, and set the at least two isolation packers 202. According to another embodiment, the specific period of time is the time needed to complete a sand control technique. According to yet another embodiment, the specific period of time is the time needed to complete a sand control technique on each interval Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. While compositions and methods are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b") disclosed herein is to be understood to set forth every number and range encompassed within the broader range of values. Also the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A method of maintaining a hydrostatic pressure exerted on a wall of a wellbore in at least a first interval and a second interval of the wellbore, comprising the steps of:

creating at least the first interval and second interval of the wellbore, wherein the step of creating comprises setting at least a top packer, a first isolation packer, and a second isolation packer in the wellbore, and wherein the first interval is located between the top packer and the first isolation packer and the second interval is located between the first and second isolation packers;

flowing a liquid through at least a first pressure regulator and a second pressure regulator, wherein the first pressure regulator is located in the first interval of the wellbore, wherein the second pressure regulator is located in the second interval of the wellbore, wherein each of the first and second pressure regulators regulates an amount of pressure exerted by the liquid on the wall of the wellbore, and wherein the first pressure regulator is part of a first sand control assembly that includes a first blank pipe and a first screen, and wherein the first pressure regulator includes a first backflow device that prevents fluid from entering an inner diameter of the first screen via the first pressure regulator from an outer diameter of the first screen when the first pressure regulator is attached to the first screen of the first sand control assembly;

maintaining liquid communication between the first and second pressure regulators and the wall of the wellbore; and maintaining the amount of pressure for a specific period of time.

2. The method according to claim 1, wherein the first backflow device prevents fluid from entering an inner diameter of the first blank pipe via the first pressure regulator from an outer diameter of the first blank pipe when the first pressure regulator is attached to the first blank pipe of the first sand control assembly.

3. The method according to claim 1, wherein at least one of the first and second intervals is part of a soft formation.

4. The method according to claim 1, wherein more than one pressure regulator is located in the first interval, the second interval, or combinations thereof.

5. The method according to claim 1, wherein the second pressure regulator is part of a second sand control assembly that includes a second blank pipe and a second screen, and wherein the first pressure regulator is attached to the first blank pipe of the first sand control assembly while the second pressure regulator is attached to the second screen of the second sand control assembly.

6. The method according to claim 1, wherein the second pressure regulator is part of a second sand control assembly that includes a second blank pipe and a second screen, and wherein at least the first sand control assembly is located in the first interval and at least the second sand control assembly is located in the second interval.

7. The method according to claim 1, wherein the second pressure regulator is part of a second sand control assembly that includes a second blank pipe and a second screen, and wherein the first pressure regulator is attached to the first screen of the first sand control assembly while the second pressure regulator is attached to the second blank pipe of the second sand control assembly.

8. The method according to claim 1, wherein the second pressure regulator is part of a second sand control assembly that includes a second blank pipe and a second screen, and wherein the first pressure regulator is attached to the first screen of the first sand control assembly while the second pressure regulator is attached to the second screen of the second sand control assembly.

9. The method according to claim 1, wherein the second pressure regulator is part of a second sand control assembly that includes a second blank pipe and a second screen, and wherein the first pressure regulator is attached to the first blank pipe of the first sand control assembly while the second pressure regulator is attached to the second blank pipe of the second sand control assembly.

10. The method according to claim 1, further comprising the step of placing at least the first pressure regulator in the first interval and at least the second pressure regulator in the second interval.

11. The method according to claim 1, wherein the step of flowing comprises pumping a liquid through the first and second pressure regulators.

12. The method according to claim 1, wherein the step of flowing comprises simultaneously flowing the fluid through the first and second pressure regulators.

13. The method according to claim 1, wherein the second pressure regulator further comprises a second backflow device distinct from the first backflow device of the first regulator.

14. The method according to claim 1, wherein the amount of pressure is predetermined.

15. The method according to claim 14, wherein the first and second pressure regulators are pre-set to the predetermined amount of pressure.

16. The method according to claim 1, wherein the first and second pressure regulators do not allow the pressure exerted on the wall of the wellbore to increase above or fall below the amount of pressure.

17. The method according to claim 1, wherein the amount of pressure is greater than the pressure exerted by fluids in the subterranean formation.

* * * * *